United States Patent [19]

Kim

[11] Patent Number: 4,847,539

[45] Date of Patent: Jul. 11, 1989

[54] COMPUTER MONITOR

[75] Inventor: Gil-Soon Kim, Kyung Ki, Rep. of Korea

[73] Assignee: Sam Sung Electron Devices Co., Ltd., Kyung Ki, Rep. of Korea

[21] Appl. No.: 161,388

[22] Filed: Feb. 22, 1988

Related U.S. Application Data

[63] Continuation of Ser. No. 657,994, Oct. 5, 1984.

[30] Foreign Application Priority Data

May 29, 1984 [KR] Rep. of Korea ..... 3054/84

[51] Int. Cl.[4] ..... H01J 29/52; G09G 1/10

[52] U.S. Cl. ..... 315/383; 340/739

[58] Field of Search ..... 315/383, 370; 340/720, 340/736, 739; 358/137, 171, 195.1

[56] References Cited

U.S. PATENT DOCUMENTS

| | | | |
|---|---|---|---|
| 3,751,706 | 8/1973 | Owens, Jr. et al. | 315/383 |
| 3,916,254 | 10/1975 | Worster et al. | 315/370 |
| 4,063,133 | 12/1977 | Nero et al. | 315/370 |
| 4,459,614 | 7/1984 | Holzgrafe | 315/370 |
| 4,491,835 | 1/1985 | Aron | 340/736 |

*Primary Examiner*—Theodore M. Blum
*Assistant Examiner*—David Cain
*Attorney, Agent, or Firm*—Cushman, Darby & Cushman

[57] ABSTRACT

The computer monitor of the invention is divided into the Composite Signal Mode and the Transistor-Transistor Logic Signal Mode types depending on the computer circuit design. The compatible monitor is comprised of a composite monitor circuit adapted to the Composite Signal Mode and a transistor-transistor logic monitor circuit adapted to the Transistor-Transistor Logic Signal Mode. It includes circuits for correcting the electrical characteristics to operate on both the composite and transistor-transistor logic computer time charts. Those circuits include a horizontal shaft circuit which is connected to the horizontal oscillation/drive circuit, a vertical shift circuit is connected to the vertical oscillation/output circuit and a flyback transformer circuit. The invention also includes a circuit selecting switch integrated with a plurality of switches for freely selecting one of the computer output signals by manual switching in accordance with the mode of the computer output signal.

5 Claims, 6 Drawing Sheets

COMPUTER MONITOR

This is a continuation of application Ser. No. 657,994, filed Oct. 5, 1984, which was abandoned upon the filing hereof.

FIELD OF THE INVENTION

The present invention relates to a computer monitor, and more particularly to a compatible computer monitor for operation in both the Composite Signal Mode and the Transistor-Transistor Logic Signal Mode.

DESCRIPTION OF THE PRIOR ART

It is well known that a computer monitor may be divided into the Composite Signal Mode and the Transistor-Transistor Logic Signal Modes types depending on the computer circuit design. Up to now, a particular computer monitor comprised of circuits suitable for processing the specific computer output signal has been used, because each of the above signal modes generated by various kinds of computers has an independent signal time chart. Therefore, it is very difficult to select a compatible computer monitor which easily interfaces with the computer output signal. Thus, there is a great demand for a computer monitor capable of satisfying customers' needs in the above respect especially as the use of computers continues to expand at a large rate. Accordingly, the present invention is designed to solve the above problem.

SUMMARY OF THE INVENTION

The present invention relates to a compatible computer monitor which can selectively operate according to a given computer output signal mode depending on the type and function of the computer. The compatible computer monitor according to the invention is comprised of a composite monitor circuit suitable for the Composite Signal Mode and a transistor-transistor logic monitor circuit suitable for the Transistor-Transistor Logic Signal Mode. Further, the compatible computer monitor is comprised of a horizontal shift circuit connected to the horizontal oscillation/drive circuit, a vertical shift circuit connected to the vertical oscillation-/output circuit and a flyback transformer circuit, and its input terminals are connected to the computer output terminals by means of switches so as to selectively receive a composite signal or transistor-transistor logic signal from the computer. The switches are integrated in a circuit selecting switch which changes the status of the monitor from composite mode to transistor-transistor logic mode and vice versa, in accordance with the kind of computer output signal.

OBJECT OF THE INVENTION

Accordingly, the primary purpose of the invention is to provide a computer monitor which can be interfaced with various computers with different output signals.

A further object of the invention is to provide a computer monitor having a circuit configuration and characteristics compatible for computer output signals which differ in kind and function.

These and other objects and advantages of the present invention will become apparent upon reading the following description of which the attached drawings form a part.

FIGS. *6a–6c* are circuit diagrams of the computer monitor in accordance with an embodiment of the invention wherein (a) is a horizontal shift circuit, (b) is a vertical shift circuit and (c) is a flyback transformer circuit.

DETAILED DESCRIPTION OF THE PREFERRED EMBODIMENT

Figure 1:
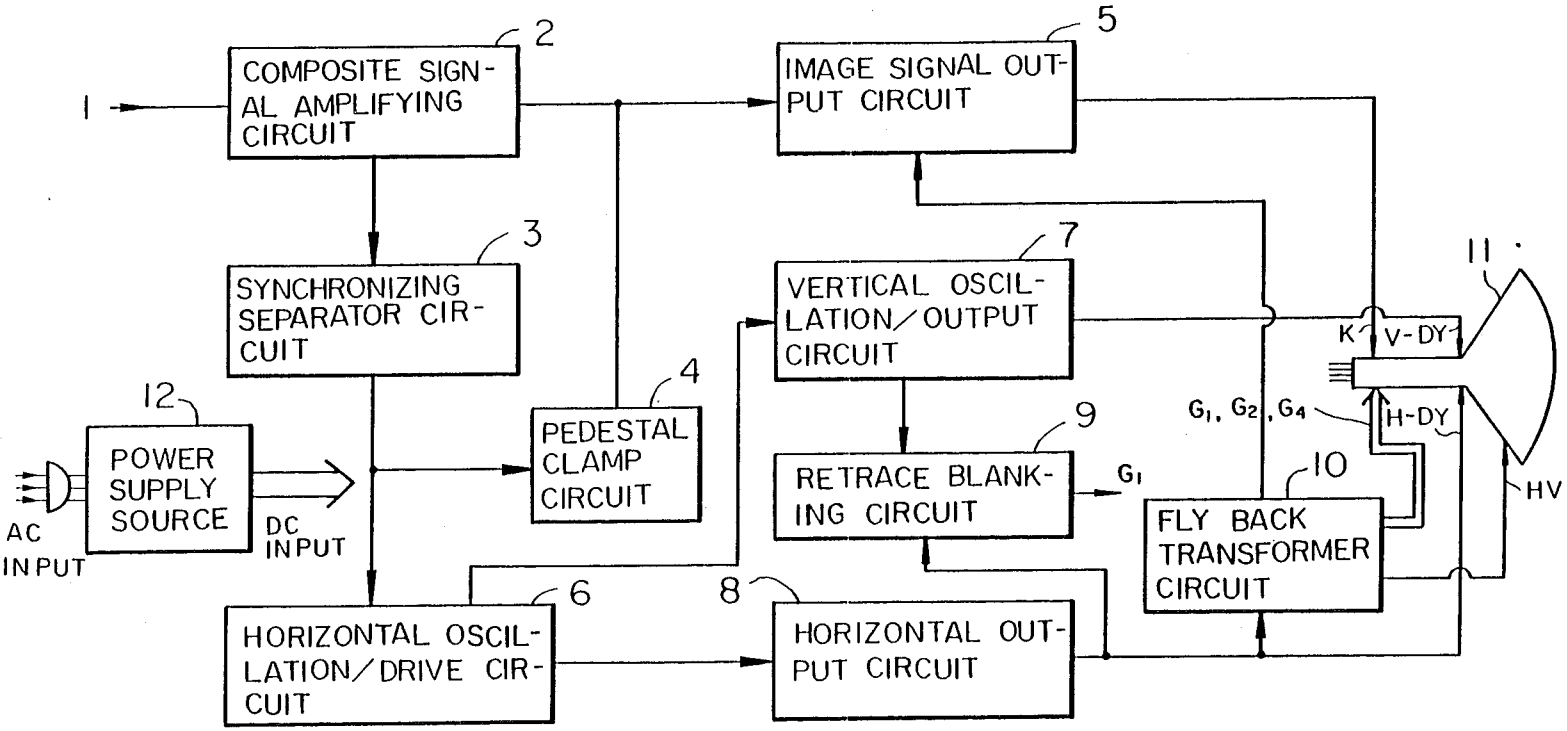
FIG. 1 illustrates a block diagram of the computer operating in the Composite Signal Mode.

FIG. 1 shows a block diagram of a computer monitor operating in the Composite Signal Mode. The composite signal (1) mixed with an image signal and the horizontal and vertical Sync signal from a computer is applied to the composite signal amplifying circuit (2) which increases the composite signal level (usually 1 volt) to the appropriate level for driving the image output stage without reducing the band pass width. The synchronizing separator circuit (3) separates the image signal from the horizontal and vertical sync signal in the composite signal produced by the composite signal amplyifying circuit (2).

The pedestal clamp circuit (4) receives the synchronizing separator signal from the synchronizing separator circuit (3) thereby stabilizing the luminance level of the image signal. Next, the pedestal clamp circuit (4) generates the bias voltage controlled by the pedestal level. The image signal output circuit (5) produces the stabilized imaging signal, based on the above bias voltage from the pedestal clamp circuit. The horizontal oscillation/drive circuit (6) separates the horizontal synchronizing signal of the synchronizing separator circuit (3) so that the vertical synchronzing signal is applied to the vertical oscillating/output circuit (7) as described later and the horizontal synchronizing signal is applied to its oscillation circuit, whereby the horizontal output stages produce the horizontal deflecting signal.

The vertical oscillation/output circuit (7) receives the vertical synchronizing signal from the horizontal oscillation/drive circuit (6) and applies the vertical synchronizing signal to its oscillation circuit to produce the vertical deflection signal and amplifies it. Thereafter, the vertical oscillation/output circuit (7) supplies an output to the vertical deflection yoke of the cathode ray tube (11) and the retrace blanking circuit (9). The horizontal output circuit (8) amplifies the horizontal deflection signal from the horizontal oscillation/drive circuit (6) and supplies an output signal to the retrace blanking circuit (9), the fly back transformer circuit (10) and the horizontal deflection yoke of the cathode ray tube (11). The retrace blanking circuit (9) cuts off the blank line by applying a rectangular minus pulse voltage to the first grid $G_1$ of the tube (11).

The fly back transformer circuit (10) receives the output signal from the horizontal output circuit (8) and applies the high voltage or the operating voltage to the cathode ray tube. The cathode ray tube (11) focuses the electron beams controlled by the image signal onto a phosphorous screen surface and displays the visual picture. The power supply source (12) transforms AC voltage into DC voltage and provides a DC voltage adapted to the computer monitor circuit.

Figure 2:
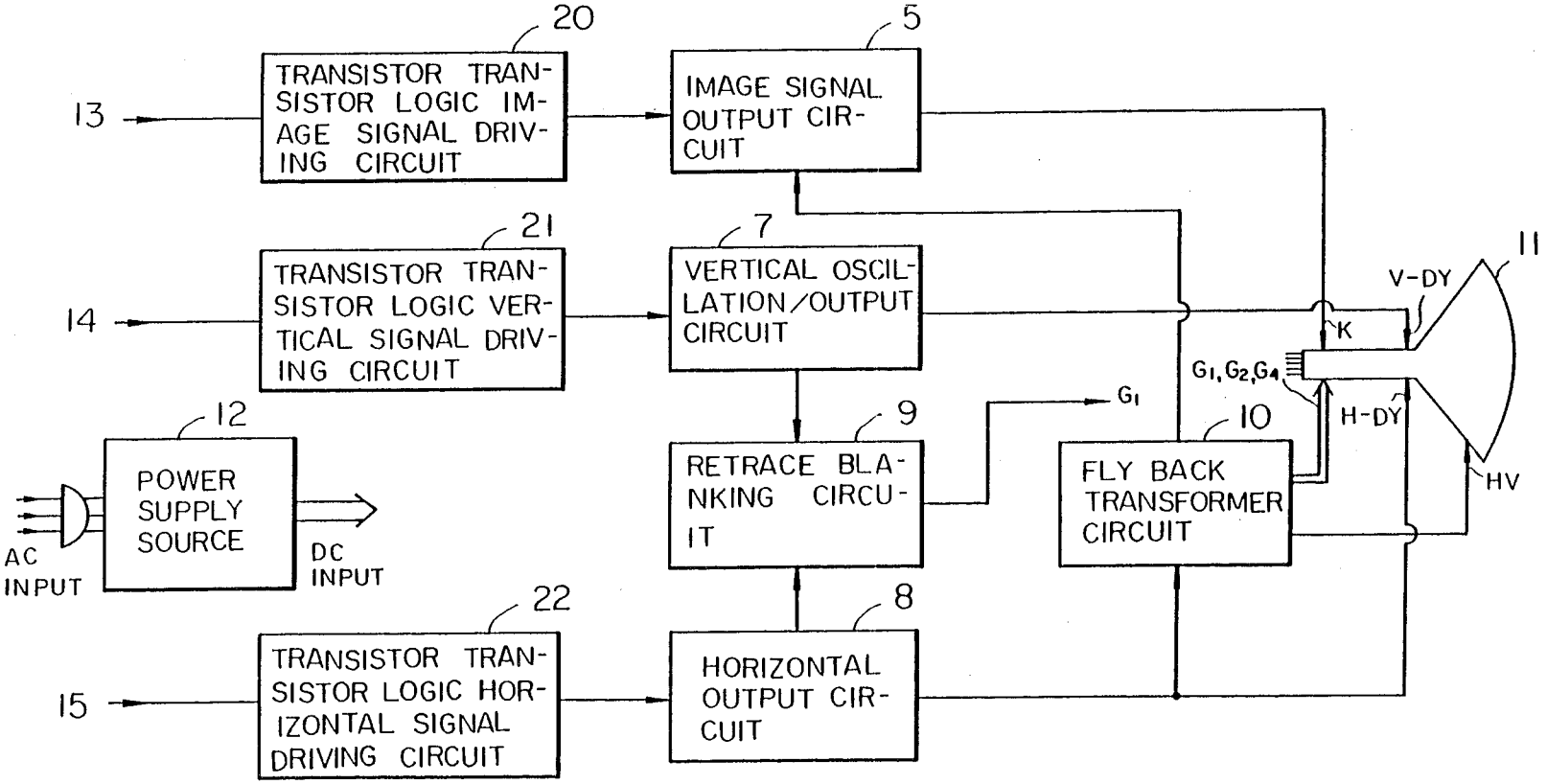
FIG. 2 illustrates a block diagram of the computer monitor operating in the Transistor-Transistor Logic Signal Mode.

FIG. 2 shows a block diagram of the computer monitor operating in the Transistor-Transistor Logic Signal Mode. A Transistor-Transistor Logic image signal (13), a Transistor-Transistor Logic vertical synchronizing signal (14) and a Transistor-Transistor Logic horizontal synchronizing signal (15) from the computer are applied to the Transistor-Transistor Logic image signal driving circuit (20), the Transistor-Transistor Logic vertical signal driving circuit (21), and the Transistor-Transistor Logic horizontal signal driving circuit (22), respectively. The Transistor-Transistor Logic image signal driving circuit (20) changes a Transistor-Transistor Logic image signal level of 4 volts, which is unsuitable for generating the Transistor-Transistor Logic image signal, into a signal level suitable for operating the image signal output circuit (5).

The Transistor-Transistor Logic vertical signal driving circuit (21) transforms the Transistor-Transistor Logic vertical pulse signal into a synchronizing differential waveform necessary for driving the vertical oscillation/output circuit (7). The Transistor-Transistor Logic horizontal signal driving circuit (22) amplifies and transforms the horizontal positive pulse signal referred to as a Transistor-Transistor Logic horizontal synchronizing signal (15) into the horizontal minus pulse signal necessary for driving the horizontal output circuit (8). Then the remaining block circuits are operated as separate block circuits having numbers identical to FIG. 1. Accordingly, the detailed description with respect to the block circuits is deleted to avoid duplication. But the above circuits are designed to differ from each other according to their output signal mode.

Figure 3:
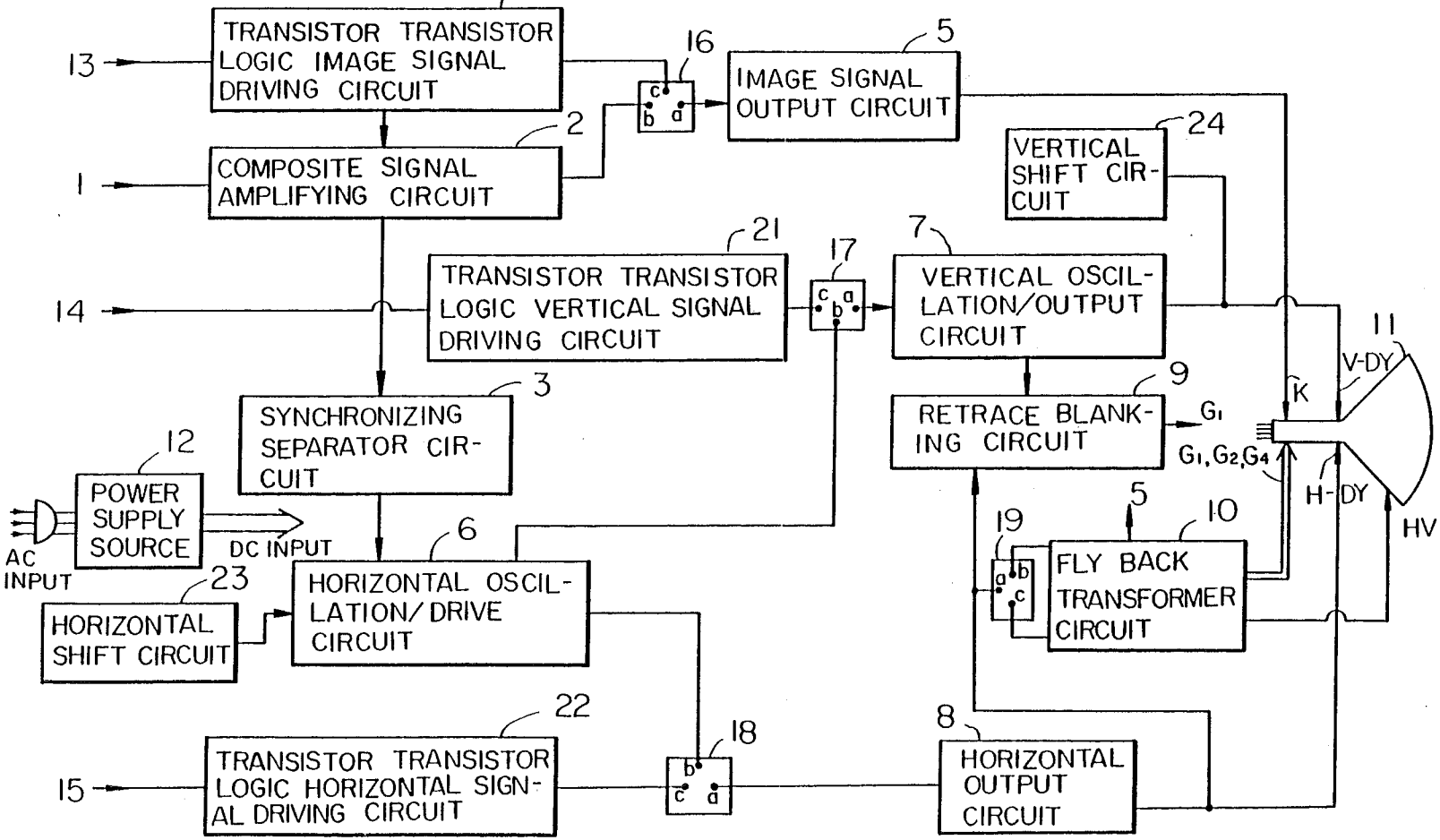
FIG. 3 illustrates a block diagram of a compatible computer monitor operating in the Composite Signal Mode and the Transistor-Transistor Logic Signal Mode in accordance with the preferred embodiment of the invention.

FIG. 3 shows a block diagram of a compatible computer monitor capable of operating in either the computer Composite Signal Mode or the Transistor-Transistor Logic Mode in accordance with the invention. The invention provides a single computer monitor combining a plurality of circuits of conventional computer monitors which differ in signal modes and which avoid the overlap of identical circuits common to conventional computer monitors.

To that end, preferred embodiment of the invention includes a horizontal shift circuit (23) connected to the horizontal oscillation/drive circuit (6), a vertical shift circuit (24) is connected to the vertical oscillation/output circuit (7), and a fly back transformer circuit (10) in accordance with various different computer signal time charts.

Figure 4:
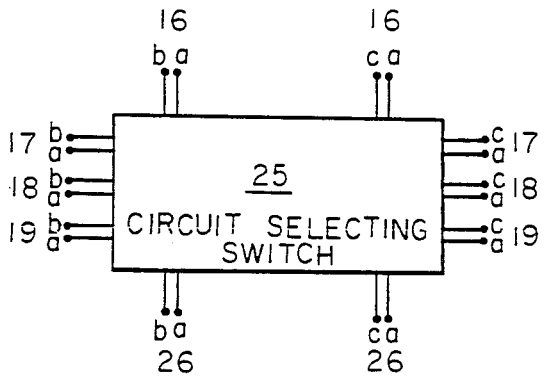
FIG. 4 is a block diagram of a circuit selecting switch of the preferred embodiment of the present invention.

Also, the computer monitor according to the invention comprises a circuit selecting switch (25) (FIG. 4) integrated with several switches (16, 17, 18, 19, 26) for connecting the appropriate computer output signal, which differs in type and function, to the monitor circuit and changing the monitor circuit to either the Composite Signal Mode or the Transistor-Transistor Logic Signal Mode by manual operation.

The description with respect to the operation of the preferred embodiment of the invention as follows. First the power supply source circuit (12) transforms an AC voltage from an external terminal into a DC voltage and supplies the DC voltage to the monitor circuit. Thereafter, if the circuit selecting switch (25) is switched to the Composite Signal Mode, the first, second, third, fourth and fifth switches (16, 17, 18, 19, 26) are simultaneously positioned to the Composite Signal Mode.

Figure 5:
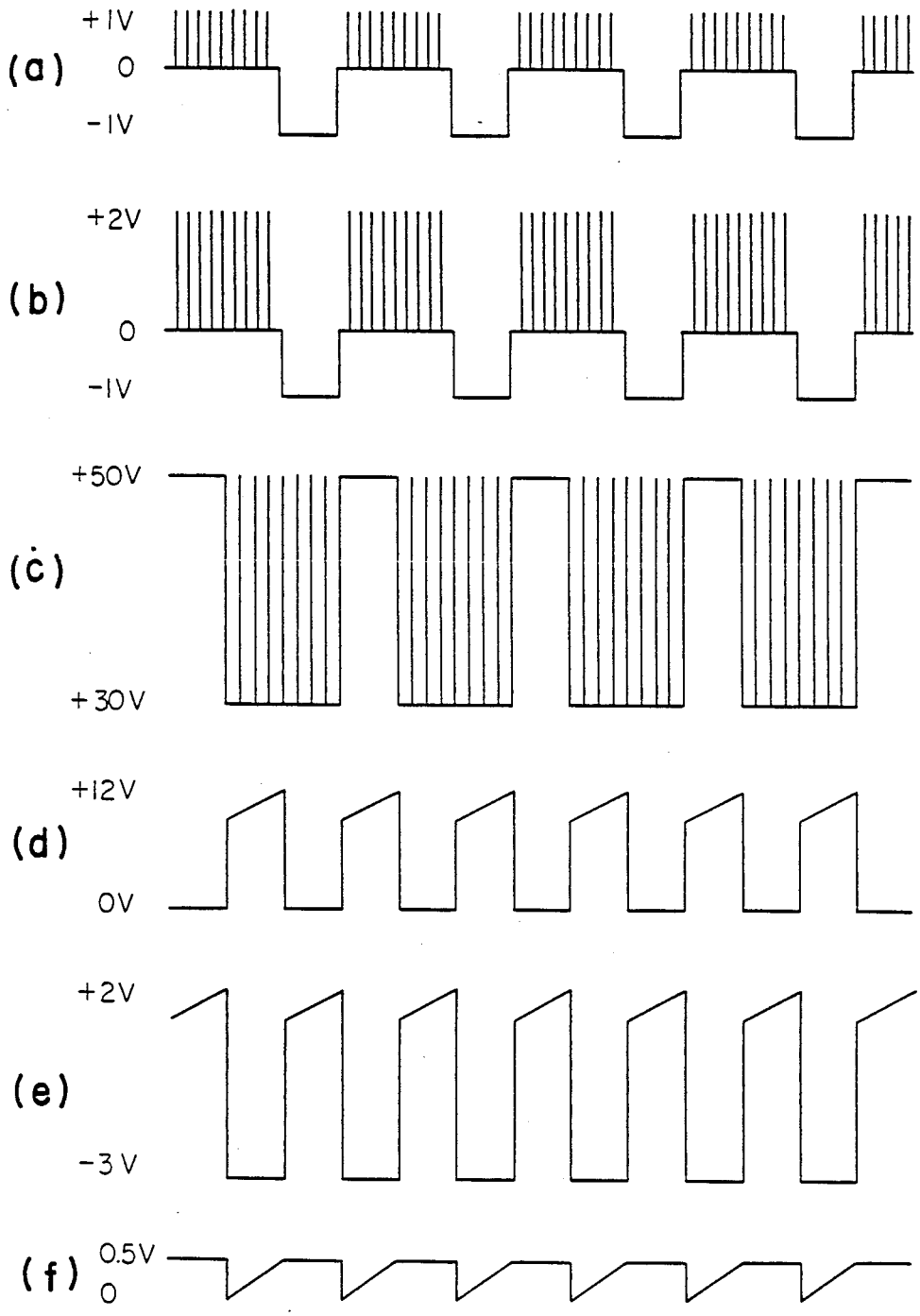
FIG. 5 is a waveform of one embodiment in accordance with the invention.

Therefore, the composite signal (1) (Referring to FIG. 5(*a*)) is inputed into the composite signal amplifying circuit (2). The composite signal amplifying circuit (2) amplifies the composite signal of 1 volt peak-to-peak (hereafter Vp-p) through a two-stage amplification to about 2Vp-p, wherein the output wave form amplified by the two-stage amplification is similiar to the waveform shown in FIG. 5(*b*). The signal from the composite signal amplifying circuit (2) is applied to the synchronizing separator circuit (3) and the image signal output circuit (5) through terminal b and a of the first switch (16) which has been switched to the Composite Signal Mode. The signal input to the image signal output circuit (5) is amplified and then is applied to cathode (k) of the cathode ray tube (11) as a signal having a luminance level determined by adding the image signal to a cathode voltage generated by the secondary windings of the fly back transformer (10) (Referring to FIG. 6(*c*)). Also the composite signal input (1) to the sychronizing separator circuit (3) is separated into the image signal and the horizontal and vertical synchronizing signals so that each signal is inputted to the horizontal oscillation/drive circuit (6) and the horizontal shift circuit (23), respectively. The horizontal and vertical synchronizing signal is oscillated/driven by the horizontal oscillation/drive circuit (6) separating the vertical synchronizing signal therefrom.

The vertical synchronizing signal as shown in FIG. 5(*d*) is applied through terminals b and a of the second switch (17) to the vertical oscillation/output circuit (7), and then is inputted to the vertical deflection yoke (V-DY) of tube (11) and the retrace blanking circuit (9). The horizontal shift circuit (23) limits and shifts the phase of the horizontal synchronizing signal to generate the horizontal deflection signal by adjusting the horizontal center of the image. Thus the horizontal deflection signal synchronized by the horizontal oscillation/drive circuit (6) and the horizontal shift circuit (23) is applied as a waveform signal shown in FIG. 5(*e*) to the horizontal output circuit (8) through the terminal b and a of the third switch (18). The horizontal deflection signal is amplified by the horizontal output circuit (8), and then is applied to the primary windings of the fly back transformer (10) through the terminal b and a of the fourth switch (19), the retrace blanking circuit (9) and the horizontal deflection yoke (H-DY) of the cathode ray tube. The vertical synchronizing signal from the horizontal oscillation/drive circuit (6) through terminal b and a of the second switch (17) is oscillated and amplified by itself in the vertical oscillation/output circuit (7) thereby generating the vertical deflection signal. Then this vertical deflection signal is applied to the vertical deflection yoke (V-DY) through the vertical shift circuit and to the retrace blanking circuit (9).

Figure 6A:
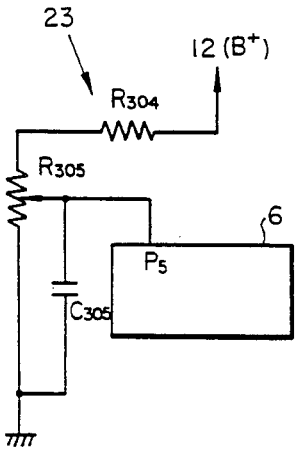
Figure 6B:
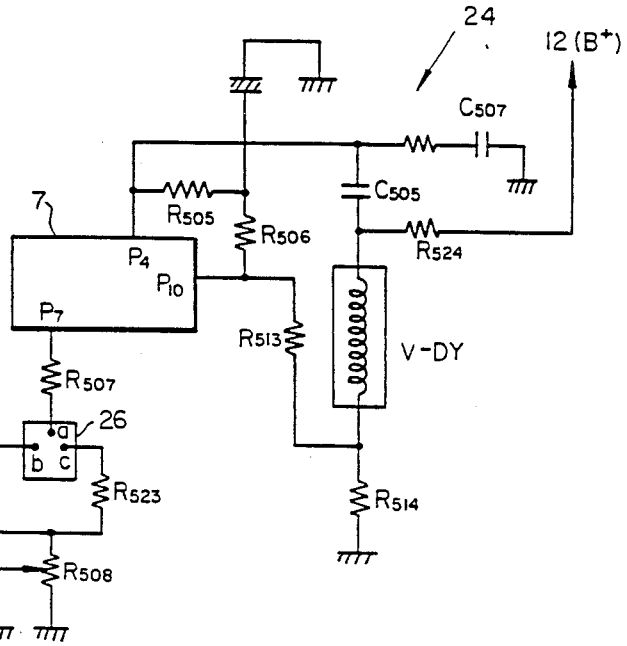
Figure 6C:
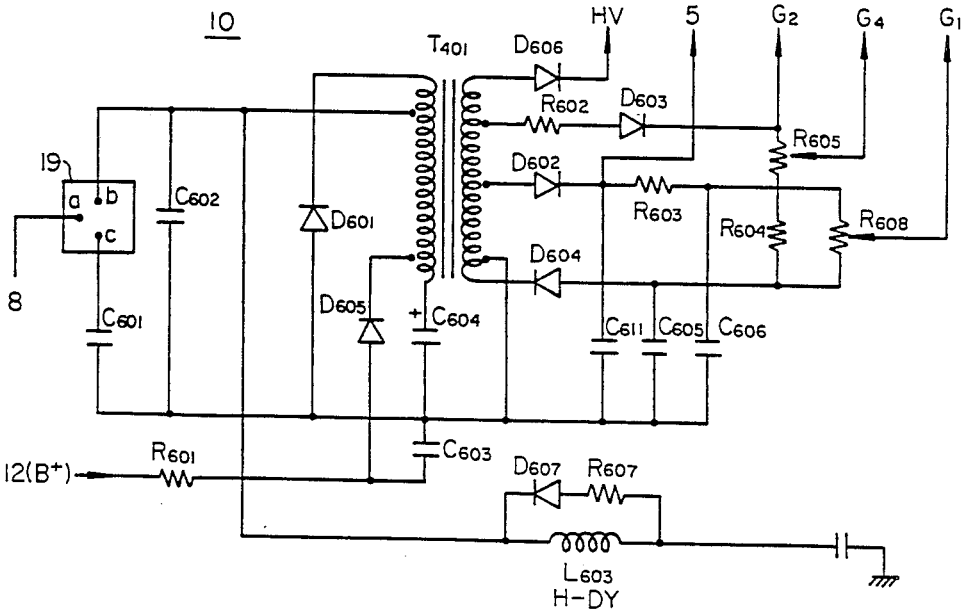

The vertical deflection signal from the vertical oscillation/output circuit (7) is passed through terminal b and a of the fifth switch (26) (shown in FIG. 6(*b*)). The output waveform from the vertical signal oscillation/output circuit (7) is the sawtooth waveform signal identical to FIG. 5(*f*). The vertical shift circuit (24) applies the potential of the power source to the sawtooth waveform signal to match the vertical deflection signal level exactly at the center of the image vertical signal level with the raster motion.

The retrace blanking circuit (9) separates only the positive pulse signal from the horizontal deflection signal and the vertical deflection signal, and inverts the positive pulses during the retrace period. Thereafter the inverted signal is applied to the first grid to inhibit generation of the retrace line to cut off the electron beam during the retrace interval. Then the horizontal deflection signal applied through the terminal b and a of the fourth switch (19) is generated as a high voltage signal by the capacitance of the capacitor and the electrical characteristics of the primary windings of the fly back transformer (10) and is induced into a horizontal deflection voltage by the secondary windings of the fly back transformer to be provided for each grid (G1, G2, G4), the cathode (k) and the high voltage electrode (HV) in the cathode ray tube (11). Therefore the electron beams are formed on the screen to display the information produced by the Composite Signal Mode.

The description with respect to the monitor circuit of the Transistor-Transistor Logic Signal Mode is as follows. When the circuit selecting switch (25) is switched to the Transistor-Transistor Logic Signal Mode, the first, second, third, fourth and fifth switches (16, 17, 18, 19, 26) are also switched to the Transistor-Transistor Logic Signal Mode. The Transistor-Transistor Logic image signal (13) from a computer is applied to the image signal output circuit (5) through terminals c and a of the first switch and then is applied to cathode (k) of the cathode ray tube (11). The luminnace level of this image signal is determined by adding the image signal to a cathode voltage obtained at the secondary windings of the fly back transformer (Referring to FIG. 6(*c*). Also the Transistor-Transistor Logic vertical synchronizing signal (14) from a computer is applied to the vertical oscillation/output circuit (7) through the Transistor-Transistor Logic vertical signal driving circuit (21) and the second switch (17). The Transistor-Transistor Logic vertical synchronizing signal (14) is oscillated and amplified in the vertical oscillation/output circuit (7) thereby generating the synchronized vertical deflection signal.

Then the vertical synchronizing signal is applied to the vertical deflection yoke (V-DY) and the retrace blanking circuit (9) through the vertical shift circuit (24). Also the vertical synchronizing signal from the vertical oscillation/output circuit (7) is passed through the fifth switch (26) to adjust the vertical width (Referring to FIG. 6(*b*)). The vertical shift circuit (24) adds the potential of the power source to the sawtooth waveform signal current to exactly match the vertical deflection signal level at the center of the image vertical signal level with the raster motion. On the other hand the horizontal synchronizing signal (15) from a computer is applied to the horizontal output circuit (8) through the Transister-Transister Logic horizontal signal driving circuit (22) and the terminals c and a of the third switch (18). The horizontal deflection signal generated by the horizontal output circuit (8) is applied simultaneously to the retrace blanking circuit (9), the primary windings of the fly back transformer (10) and the horizontal deflection yoke of the cathode ray tube (11). The horizontal deflection signal inputted through the terminals c and a of the fourth switch (19) is generated as a high voltage signal by the primary windings of the fly back transformer and induced into a horizontal deflection voltage by the secondary windings of the fly back transformer to be provided for each grid (G1, G2, G4), the cathode (k) and the high voltage electrode (HV) in cathode ray tube (11). The electron beams are formed on the screen according to the image signal of the cathode, the vertical deflection current of the vertical deflection yoke (V-DY) and the horizontal deflection current of the horizontal deflection yoke (H-DY) to display the information by the Transistor-Transistor Logic Signal Mode.

FIG. 6 shows circuits of the invention for correcting characteristics of a computer monitor in order to operate in accordance with the respective computer output mode wherein (a) illustrates the horizontal shift circuit, (b) shows the vertical shift circuit including the fifth switch (26) for adjusting the vertical width and the vertical oscillation/output circuit (7) and (c) depicts the fly back transformer circuit (10).

First referring to the horizontal shift circuit of FIG. 6(*a*), the output signal at the pin (P5) of the horizontal oscillation/drive circuit (6) is adjusted by comparing the fly back pulse with the oscillation waveform. Such adjustment is established by the filter comprised of resistor (R305) and capacitor (C305) for limiting and shifting the output phase of pin (P5). But the image horizontal center of the Composite Signal Mode and the image horizontal center of the Transistor-Transistor Logic Mode are not exactly brought in line with each other, because the Composite Signal Mode and the Transistor-Transistor Logic Signal Mode, respectively, have 15.75 KHz and 18.499 KHz as their horizontal frequencies thereby generating a horizontal output of the fly back time different from each other and having an image gap different from each other. Thus, the image horizontal center of the Transistor-Transistor Logic Mode is adjusted by the ring magnet of the horizontal deflection yoke (H-DY), and horizontal center of the Composite Signal Mode is adjusted by using the horizontal shift circuit (24).

The description with respect to the vertical shift circuit of FIG. 6(*b*) is as follows. The sawtooth wave current of pin (P4, P10) of the vertical oscillation/output circuit (7) is supplied to the vertical deflection yoke (V-DY). The vertical oscillation/output circuit (7) cannot fix the image vertical center because the Composite Signal Mode and the Transistor-Transistor Logic Signal Mode have 50 Hz and 60 Hz respectively as their vertical frequency. Therefore, in accordance with this invention the image vertical center of the Composite Signal Mode is adjusted by the ring magnet of the vertical deflection yoke (V-DY), and the image vertical center of the Transistor-Transistor Logic Signal Mode is fixed by applying the potential of the source (B+) (12) to the sawtooth wave current of the vertical deflection yoke (V-DY) while moving the raster. Also, the vertical deflection signals of both modes are formed to have vertical signal widths different from each other according to the vertical frequency difference between the Transistor-Transistor Logic Signal Mode and the Composite Signal Mode. As is well known in this field, the vertical signal width is set by adjusting the output voltage level of pin (P7) of the vertical oscillation/output circuit (7) by using the variable resistor (R508).

On the other hand, the vertical signal width of the Transistor-Transistor Logic Signal Mode is larger than that of the Composite Signal Mode by 50 m/m. As to this, in this invention when the computer monitor is operated in the Transistor-Transistor Logic Signal Mode, the output voltage level of pin (P7) is adjusted so that the vertical signal width and the horizontal signal width have the ideal value, for example 3:4, by serially connecting the resistor (R523) to the variable resister (R508).

The description with respect to the fly back transformer circuit (10) of FIG. 6(*c*) is as follows. The fly back transformer circuit (10) is designed to operate according to the electrical characteristics of the Composite Signal Mode or the Transistor-Transistor Logic Signal Mode. Now, the circuit characteristics of the fly back transformer circuit will be described below, but the general operation of the fly back transformer circuit (10) will be deleted. The electrical conditions of the Composite Signal Mode and the electrical conditions of the Transistor-Transistor Logic Signal Mode are satisfied with one fly back transformer having electrical characteristics as shown in table I according to the invention. Thus the flyback transformer circuit (10) of the invention is provided with the capacitor (C604) having a capacitance value selected by the switch (19) at the primary windings of the fly back transformer to prevent the electrical characterictics of each Signal Mode from malfunctioning in the reverse action and to satisfy the electrical characteristics of each Signal Mode. On the other hand, the electrical constants of the fly back transformer and the horizontal deflection yoke adapted to the invention are determined by experimental adjustment to operate in both modes. Therefore, it is noted that the object of the invention is to construct a compatible monitor have electrical characteristics as shown in Table 1.

Accordingly, in the invention the time constants of the resonance capacitance are adjusted according to the electrical constants of the fly back transformer and the horizontal deflection yoke to determine the secondary windings' voltage of the fly back transformer, the retrace time and the horizontal signal width suitable for the electrical characteristics of both modes, and to form the saw tooth wave for the horizontal deflection yoke of both modes. Also the secondary windings of the fly back transformer generate various voltages which are, for example, supplied to the High Voltage electrode through the diode (D606), the second Grid through the Resistor (R602) and the diode (D603), and the first Grid as the difference between the voltage of the diode (D602) and the voltage of the diode (D604).

The voltage of the power source of the fly back transformer is boosted up by passing it through the capacitor (C604) and supplying it to the Primary windings of the fly back transformer.

TABLE 1

| The electrical characteristics | Composite Signal Mode | Transistor-Transistor Logic Signal Mode | The present invention |
|---|---|---|---|
| Horizontal Frequency | 15.75 KHz | 18.449 KHz | 18.449 KHz −15.75 KHz |
| Source Voltage (B+) | 15 V | 15 V | 15 V |
| Retrace time | 9.9 μS | 7.3 μS | 7.3 μS |
| The resonance Capacitor | 0.066 μF | 0.039 μF | 0.022 μF −0.044 μF |
| High Voltage | 13.5 KV | 13 KV | 13 KV |
| Horizontal Signal Width | 216 m/m | 204 m/m | 204 m/m −216 m/m |

The electrical characteristics of reverse action means that though the computer monitor is intended to operate in the Transistor-Transistor Logic Signal Mode, substantially the computer monitor is operated in the Composite Signal Mode or malfunctions in the Transistor-Transistor Logic Signal Mode. For instance, the Transitor-Transistor Logic Signal Mode has the horizontal frequency of 18.449 KHz and the retrace blanking time of 7.3 μS to display the image within the range of the raster. Also the Transistor-Transistor Logic Signal Mode has a high voltage of 13 KV, the horizontal signal width of 204 m/m and the capacitor's capacitance of 0.039 μF to coincide with the above conditions as shown in Table 1. But if the electrical characteristics of Transistor-Transistor Logic Signal Mode is adapted to the Composite Signal Mode, the High voltage of the Composite Signal Mode is increased to 19 KV and the horizontal signal width of 180 m/m is formed. Thus, the invention provides the capacitor selected by switch (19) to satisfy the electrical characteristic of both the Signal Mode and to adjust the primary and secondary windings of the fly back transformer.

As it is seen from the above description, a prior art computer monitor must be selected to match the circuit configuration and the electrical characteristics of the output Signal Mode of the Computer. This invention provides for a computer monitor which is operable independent of how the various computer output signal modes differ in type and function giving the user an advantage of flexibility.

I claim:

1. A computer monitor for operating according to computer output signal modes, including a composite signal mode and a transistor-transistor logic signal mode, which differ in type and function, comprising:

a horizontal shift circuit connected to a horizontal oscillation/drive circuit of said computer monitor;

a vertical shift circuit connected to a vertical oscillation/output circuit of said computer monitor;

a fly back transformer circuit for selectively generating a composite video signal and a transistor-transistor logic video signal; and a circuit selecting switch for supplying the composite video signal or the transistor-transistor logic video signal to said computer monitor and changing the computer monitor from the composite signal mode to the transistor-transistor logic signal mode and vice versa.

2. A computer monitor as set forth in claim 1, wherein said fly back transformer circuit is provided with one fly back transformer for satisfying both the electrical characteristics of the composite signal mode and the transistor-transistor logic signal mode and a capacitor having a capacitance value selected by said circuit selecting switch at primary windings of said fly back transformer.

3. A computer monitor as set forth in claim 1, wherein said horizontal shift circuit is provided with a filter comprised of a resistor and a capacitor for limiting and shifting the output phase of the horizontal oscillation/drive circuit, thereby generating a horizonal output of the fly back time and image gaps different from each other in the composite signal mode and transistor-transistor logic signal mode.

4. A computer monitor as set forth in claim 1, wherein said vertical shift circuit has a resistor and a variable resistor for generating a vertical signal width and a horizontal signal width having a ratio of a predetermined value.

5. A computer monitor as set forth in claim 4 wherein said predetermined value is 3:4.

* * * * *